US007527236B2

(12) United States Patent
Nasvik

(10) Patent No.: US 7,527,236 B2
(45) Date of Patent: May 5, 2009

(54) FORM LINER WITH CONNECTION REGIONS HAVING A PLURALITY OF LINEAR SEGMENTS FOR CREATING A REALISTIC STONE WALL PATTERN

(76) Inventor: Paul C. Nasvik, 320 River Rd., Hudson, WI (US) 54016

( * ) Notice: Subject to any disclaimer, the term of this patent is extended or adjusted under 35 U.S.C. 154(b) by 400 days.

(21) Appl. No.: 11/012,026

(22) Filed: Dec. 14, 2004

(65) Prior Publication Data

US 2006/0157634 A1 Jul. 20, 2006

(51) Int. Cl.
*E04G 9/10* (2006.01)

(52) U.S. Cl. ..... 249/16; 249/55

(58) Field of Classification Search ..... 249/15, 249/16, 112, 55, 140; 52/311.2
See application file for complete search history.

(56) References Cited

U.S. PATENT DOCUMENTS

| | | | | | |
|---|---|---|---|---|---|
| 1,636,396 | A | | 7/1927 | Urschel | |
| 2,006,910 | A | * | 7/1935 | Brooks | 52/606 |
| 2,577,241 | A | | 12/1951 | Gibson et al. | |
| 3,177,279 | A | | 4/1965 | Bilodeau | |
| 3,307,822 | A | | 3/1967 | Stout | |
| 3,524,790 | A | | 8/1970 | Mason | |
| 4,135,840 | A | * | 1/1979 | Puccini et al. | 404/93 |
| RE29,945 | E | | 3/1979 | Scott | |
| 4,275,540 | A | | 6/1981 | Keller | |
| 4,773,790 | A | * | 9/1988 | Hagenah | 404/41 |
| 5,225,134 | A | | 7/1993 | Nasvik et al. | |
| 5,232,646 | A | | 8/1993 | Nasvik et al. | |
| 5,286,139 | A | * | 2/1994 | Hair | 404/41 |
| 5,342,142 | A | * | 8/1994 | Barth et al. | 404/41 |
| 5,386,963 | A | | 2/1995 | Nasvik et al. | |
| 5,487,656 | A | * | 1/1996 | Kaitanjian | 425/385 |
| 5,536,557 | A | | 7/1996 | Nasvik et al. | |
| 5,624,615 | A | | 4/1997 | Sandorff | |
| 5,632,922 | A | | 5/1997 | Nasvik et al. | |
| 5,637,236 | A | | 6/1997 | Lowe | |
| 5,733,470 | A | * | 3/1998 | Roth et al. | 249/2 |
| 5,884,445 | A | * | 3/1999 | Woolford | 52/311.2 |
| 5,885,502 | A | * | 3/1999 | DeAngelis et al. | 264/219 |
| 5,887,846 | A | * | 3/1999 | Hupp | 249/2 |
| D429,530 | S | * | 8/2000 | Fleishman | D25/113 |
| 6,129,329 | A | | 10/2000 | Nasvik et al. | |
| 6,237,294 | B1 | | 5/2001 | Rygiel | |
| 6,309,716 | B1 | * | 10/2001 | Fisher et al. | 428/33 |
| 6,478,867 | B1 | | 11/2002 | Cheyrezy et al. | |

(Continued)

OTHER PUBLICATIONS

Milestones Inc. website printout—www.milesstones-online.com—Jul. 23, 2004.

(Continued)

*Primary Examiner*—Gay Ann Spahn
(74) *Attorney, Agent, or Firm*—Kinney & Lange, P.A.

(57) ABSTRACT

The form liner of the present invention simulates a natural stone wall having a random pattern. The form liner comprises an outer edge and a surface that is contoured to resemble a plurality of stones held together by an adhesive substance. The outer edge of the form liner has six connection regions made up of multiple linear segments. No two adjacent connection regions are connected at a ninety degree angle and no linear segment of the fifth connection region lies along the same linear path as any linear segment of the sixth connection region.

26 Claims, 12 Drawing Sheets

U.S. PATENT DOCUMENTS

| | | | | |
|---|---|---|---|---|
| 6,634,617 | B2 | 10/2003 | Potvin | |
| 6,881,463 | B2 * | 4/2005 | Riccobene | 428/44 |
| 2005/0210811 | A1 * | 9/2005 | Nasvik | 52/596 |
| 2006/0197257 | A1 * | 9/2006 | Burt et al. | 264/255 |
| 2007/0217865 | A1 * | 9/2007 | Castonguay et al. | 404/41 |

OTHER PUBLICATIONS

Form Liner Pattern—MS-1001 12" Cutstone, from www.milestones-online.com/patterns/pdfs/ms-1001.pdf; dated Apr. 25, 2003.

Form Liner Pattern—MS-1002 Large Random Ashlar, from www.milestones-online.com/patterns/pdfs/MS-1002.pdf; dated Apr. 25, 2003.

Form Liner Pattern—MS-1003 English Drystack, from www.milestones-online.com/patterns/pdfs/MS-1003.pdf; dated Apr. 25, 2003.

Form Liner Pattern—MS-1004 Wisconsin Fieldstone, from www.milestones-online.com/patterns/pdfs/MS-1004.pdf; dated Apr. 25, 2003.

Form Liner Pattern—MS-1005 16" Cutstone, from www.milestones-online.com/patterns/pdfs/MS-1005.pdf; dated Apr. 25, 2003.

Form Liner Pattern—MS-1006 Small Random Ashlar, from www.milestones-online.com/patterns/pdfs/MS-1006.pdf; dated Apr. 25, 2003.

Form Liner Pattern—MS-1007 Rectangular Cutstone, from www.milestones-online.com/patterns/pdfs/MS-1007.pdf; dated Apr. 25, 2003.

Form Liner Pattern—MS-1008 16" Wisconsin Fieldstone, from www.milestones-online.com/patterns/pdfs/MS-1008.pdf; dated Apr. 25, 2003.

Form Liner Pattern—MS-1009 20" Wisconsin Fieldstone, from www.milestones-online.com/patterns/pdfs/MS-1009.pdf; dated Apr. 25, 2003.

Form Liner Pattern—MS-1010 Madison Junction, from www.milestones-online.com/patterns/pdfs/MS-1010.pdf; dated Apr. 25, 2003.

Form Liner Pattern—MS-1011 16" Weathered Limestone, from www.milestones-online.com/patterns/pdfs/MS-1011.pdf; dated Apr. 25, 2003.

Form Liner Pattern—MS-1012 24" Weathered Limestone, from www.milestones-online.com/patterns/pdfs/MS-1012.pdf; dated Apr. 25, 2003.

Form Liner Pattern—MS-1013 Large Random Basalt, from www.milestones-online.com/patterns/pdfs/MS-1013.pdf; dated Apr. 25, 2003.

Form Liner Pattern—MS-1014 Shepherds Path, from www.milestones-online.com/patterns/pdfs/MS-1014.pdf; dated Apr. 25, 2003.

Form Liner Pattern—MS-1015 9" Weathered Limestone, from www.milestones-online.com/patterns/pdfs/MS-1015.pdf; dated Apr. 25, 2003.

Form Liner Pattern—MS-1016 Rivercobble, from www.milestones-online.com/patterns/pdfs/MS-1016.pdf; dated Oct. 29, 2003.

Form Liner Pattern—MS-1017 Road To Georgetown Retaining Wall, from www.milestones-online.com/patterns/pdfs/MS-1017.pdf; dated Aug. 16, 2003.

Form Liner Pattern—MS-1018 16" Weathered Limestone 2" relief, from www.milestones-online.com/patterns/pdfs/MS-1018.pdf; dated Apr. 25, 2003.

Form Liner Pattern—MS-1019 Reduced Relief Ashar, from www.milestones-online.com/patterns/pdfs/MS-1019.pdf; dated Feb. 10, 2004.

Form Liner Pattern—MS-1020 Flat Small Ashlar, from www.milestones-online.com/patterns/pdfs/MS-1020.pdf; dated Feb. 10, 2004.

Form Liner Pattern—MS-1021 Medium Rubble Stone, from www.milestones-online.com/patterns/pdfs/MS-1021.pdf; dated Apr. 1, 2004.

Form Liner Pattern—MS-1022 12" Weathered Limestone 3" relief, from www.milestones-online.com/patterns/pdfs/MS-1022.pdf; dated May 18, 2004.

Form Liner Pattern—MS-2001 Yosemite Guardwall, from www.milestones-online.com/patterns/pdfs/MS-2001.pdf; dated Apr. 25, 2003.

Form Liner Pattern—MS-2002 30" Small Ashlar Guardwall, from www.milestones-online.com/patterns/pdfs/MS-2002.pdf; dated Apr. 25, 2003.

Form Liner Pattern—MS-2003 24" Small Ashlar Guardwall, from www.milestones-online.com/patterns/pdfs/MS-2003.pdf; dated Apr. 25, 2003.

Form Liner Pattern—MS-2004 Lassen Volcanic Guardwall, from www.milestones-online.com/patterns/pdfs/MS-2004.pdf; dated Apr. 25, 2003.

Form Liner Pattern—MS-4001 Large Ashlar—Rectangular, from www.milestones-online.com/patterns/pdfs/MS-4001.pdf; dated Apr. 25, 2003.

* cited by examiner

FORM LINER WITH CONNECTION REGIONS HAVING A PLURALITY OF LINEAR SEGMENTS FOR CREATING A REALISTIC STONE WALL PATTERN

CROSS-REFERENCE TO RELATED APPLICATION(S)

None.

BACKGROUND OF THE INVENTION

The present invention relates generally to wall structures constructed from hardenable material, such as concrete. In particular, the present invention relates to concrete walls that are constructed from form liners which can be placed next to one another to form a wall surface which resembles a wall made from stones.

Wall structures can be constructed from a single uniform building material such as concrete or drywall, or from unique individual building materials such as natural stones, cut stones, or bricks that are bonded together with an adhesive substance, such as mortar. When a continuous wall structure is formed from a uniform building material, the surface of the wall will typically have a smooth surface. By contrast, when a continuous wall structure is formed by arranging individual building materials relative to each other and maintaining them in place with an adhesive substance, the surface of the wall can have a random pattern, which may be more pleasing to the eye.

Although a wall comprised of individual stones may be desirable, building such a wall is not always a practical option. Constructing a wall made of stone is often labor intensive and requires highly skilled laborers. Specialized equipment and tools may also be required. In addition, the costs of the materials themselves are high, and the cost of the labor involved is likewise high.

An alternative to constructing a wall from natural or cut stones is to construct a wall using a moldable building material, such as concrete. Using concrete, a simulated stone wall can be created such that the surface of the wall looks as though the wall was built using individual stones. This can be accomplished by utilizing a system of forms and form liners placed inside a concrete form. The form liners are created with a reverse impression of a random pattern of stones and mortar. The concrete is poured into the form and is allowed to harden. After the concrete material hardens, the forms and form liners are removed to reveal a simulated stone wall.

Concrete is a particularly suitable material for building simulated stone walls because it results in a more realistic texture and feel, and resembles stone more than other types of building materials. However, forming a simulated stone wall using several form liners to create the stone pattern has been impractical to date. To get a more realistic, random appearance of stones, a large number of form liners may be needed. In addition, it is difficult to mask the joint created where adjacent form liners meet, which may result in the ability to determine the location of each form liner on the finished wall, which in turn makes the wall more obviously simulated rather than realistic.

In forming the simulated stone wall, it is typical in the field to use multiple form liners in an attempt to make a more realistic wall. A more random pattern can be achieved by increasing the number of form liners used in the wall when each form liner creates a different pattern of stones. However, the greater the number of form liners required to achieve a random appearance, the greater the cost of the finished wall.

In an effort to reduce cost, it is desirable to design the form liners so that fewer form liner patterns are required, and the form liners can be repeated along the length of the wall while still achieving a random pattern.

Two problems are frequently encountered when a form liner is repeated in a continuous structure. The first problem arises due to the manner in which the form liners are arranged next to each other on the form. When individual form liners having generally linear sides are positioned adjacent to one another, it may become possible for the human eye to identify the joint created by the form liners in the finished wall. This is particularly true when the shape of the form liner is a simple shape, such as a rectangle. In addition, horizontal and vertical lines created in the stone pattern by the locations where the form liners are arranged are often more visible when the wall structure is viewed from an angle.

In an effort to reduce the visibility of lines in the resulting wall structure caused by the location of where the form liners are arranged next to one another, form liner systems have been developed which vary the outer shape of the form liner. Rather than making the form liner a simple a rectangular shape, the shape of the form liner is modified along its horizontal side, vertical side, or both by increasing the number of sides of the form liner. In addition, the angle at which the sides of the form liner intersect one another may also be varied. Such multi-sided form liners increases the complexity of manufacturing the wall, because the form liners must be carefully arranged on the form to ensure they fit next to each other properly and in the most efficient manner.

A second problem arises because the human eye is proficient at identifying repeating patterns. When a limited number of form liners are used to create a wall, individual shapes and patterns may be more easily discerned. This problem is particularly true of simulated natural and cut stone walls because in a real stone wall, every stone surface is unique. As a result, in making a simulated stone wall, if one of the form liners has a particularly distinctive stone, that stone may be more noticeable to the human eye if it appears more than once in the resulting wall.

Some multiple-sided form liners are designed so that the form liner can be rotated when it is placed adjacent another form liner on the form. The ability to rotate the form liner and still fit it to an adjacent form liner reduces the number of form liners required to obtain a suitably random appearing wall because merely inverting the stones makes them much more difficult for the human eye to recognize even when the pattern is repeated. This in turn reduces the cost of the resulting wall, and reduces the complexity of placing the form liners on the wall. However, such form liners may still result in obvious horizontal or vertical joint locations, and may only minimize, rather than eliminate, the ability to recognize repeating patterns in the finished wall.

Thus, there is a need in the art for a form liner that when properly arranged into a form liner system simulates a stone wall having a random appearance with no discernable horizontal or vertical lines or repeating patterns.

BRIEF SUMMARY OF THE INVENTION

The form liner of the present invention is used to create a simulated stone wall having a random pattern while masking the horizontal or vertical connections. The form liner comprises an outer edge and a surface formed by reverse impression that is contoured to resemble a plurality of stones held together by an adhesive substance. The outer edge of the form liner has a first, second, third, fourth, fifth, and sixth connection region. Each connection region is non-linear and made of multiple segments. In placing a plurality of form liners adjacent one another to form a wall, each connection region of a form liner mates with only one corresponding connection region of an adjacent form liner. No linear segment defining the fifth connection region follows the same linear path as any linear segment defining the sixth connection region.

While the above-identified figures set forth preferred embodiments of the invention, other embodiments are also contemplated, as noted in the discussion. In all cases, this disclosure presents the invention by way of representation and not limitation. It should be understood that numerous other modifications and embodiments can be devised by those skilled in the art which fall within the scope and spirit of the principles of this invention.

DETAILED DESCRIPTION

Figure 1:
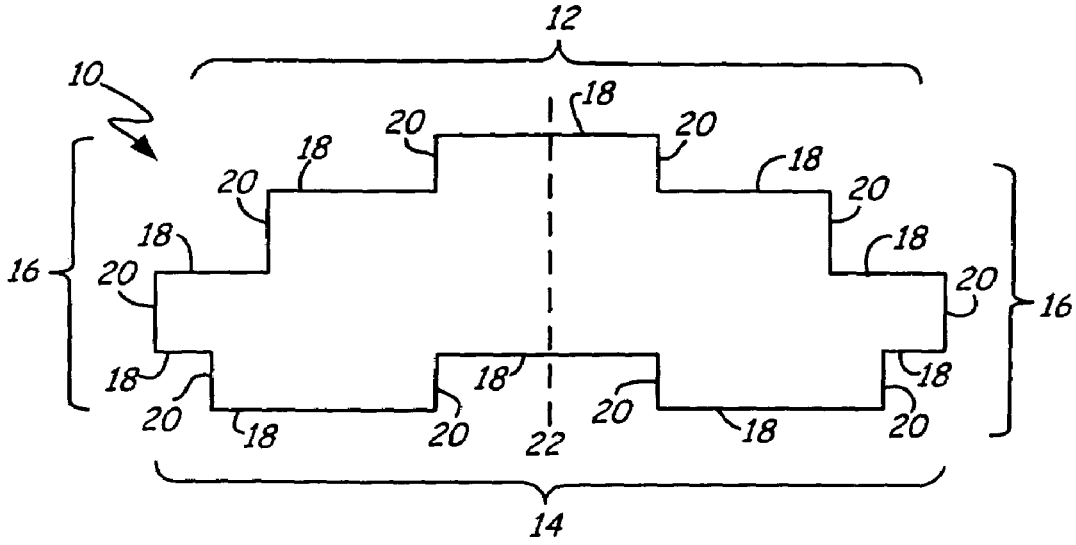
Fig. 1 PRIOR ART
FIG. 1 is a front view of a first embodiment of an individual prior art form liner.
Figure 2:
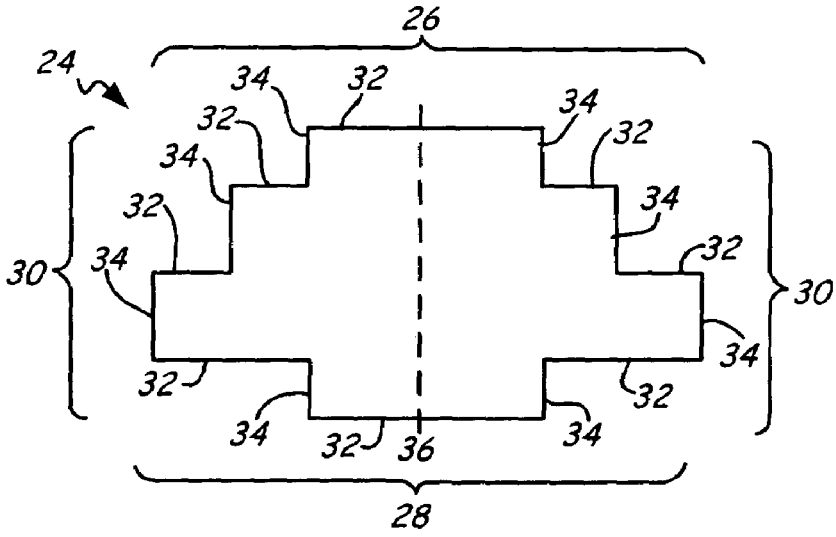
Fig. 2 PRIOR ART
FIG. 2 is a front view of a second embodiment of an individual prior art form liner.

FIGS. 1 and 2 represent two different embodiments of prior art form liners. FIG. 1 shows a front view of a first embodiment of a prior art form liner 10. Prior art form liner 10 comprises top region 12, bottom region 14, and side regions 16 made of twenty horizontal segments 18 and vertical segments 20 connected to each other at ninety degree angles with relatively long linear top and bottom regions 12 and 14. Prior art form liner 10 has an axis of symmetry 22 which results in prior art form liner 10 having "mirror" symmetry.

When several prior art form liners 10 are placed adjacent to one another to pour a wall, the relatively long linear top and bottom regions 12, 14 tend to align in rows. The rows created by the top and bottom regions 12, 14 may become discernible to the human eye. Repeating patterns which are easily discernible are less desirable because it is more obvious the resulting wall is simulated, rather than made of unique individual components.

FIG. 2 shows a front view of a second embodiment of a prior art form liner 24. Prior art form liner 24 comprises top region 26, bottom region 28, and vertical regions 30 made of sixteen horizontal and vertical segments 32 and 34 connected to each other at ninety degree angles with relatively long linear top and bottom regions 26 and 28. Prior art form liner 22 also has an axis of symmetry 36 which results in prior art form liner 24 having "mirror" symmetry. Though less obvious, the prior art form liners 24 may also cause horizontal rows to appear in a wall formed from several form liners 24 arranged next to each other on a form.

Figure 3:
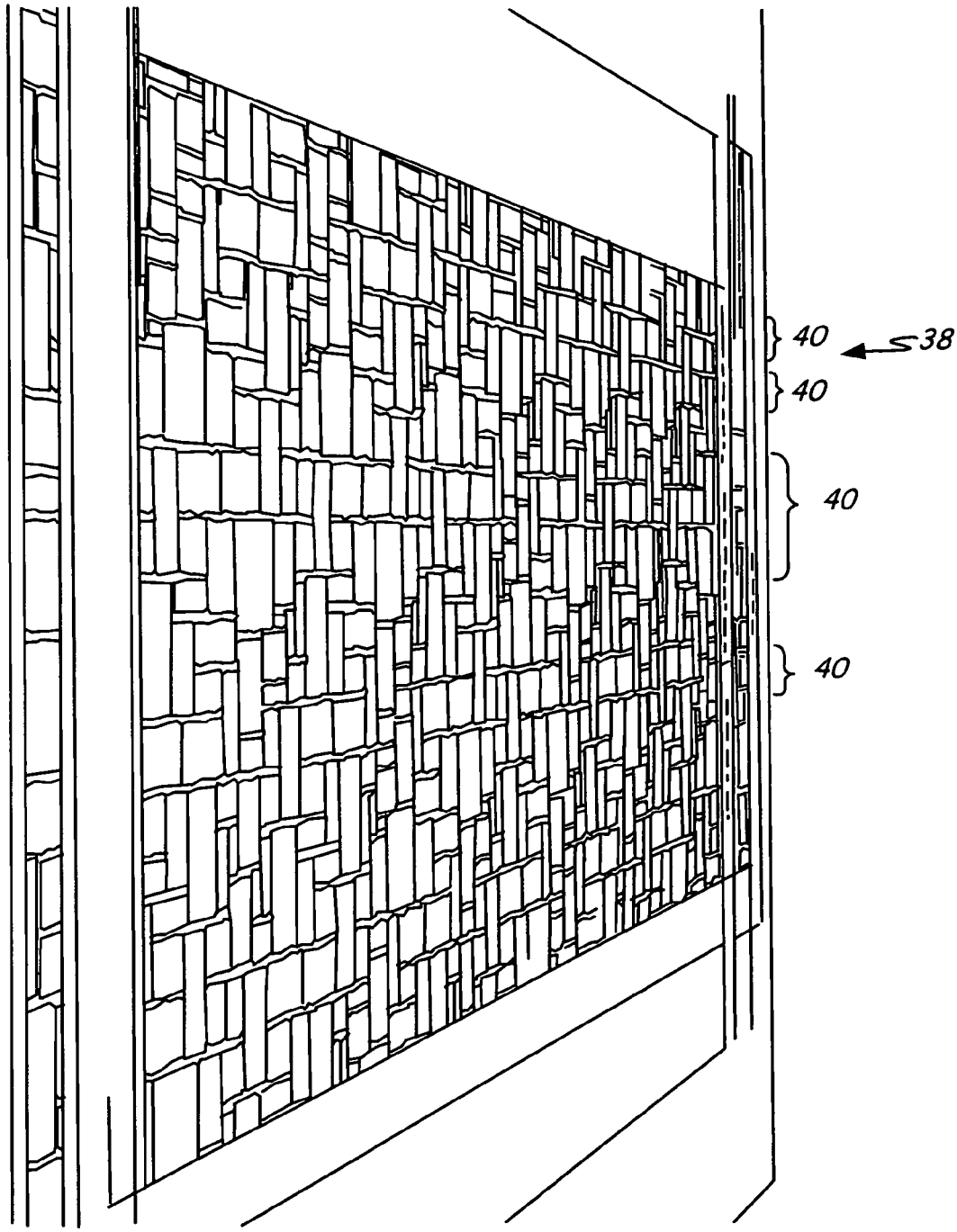
Fig. 3 PRIOR ART
FIG. 3 is a perspective view of a simulated stone wall constructed from prior art form liners.

FIG. 3 is a perspective view of a simulated stone wall 38 constructed from a plurality of prior art form liners similar to those illustrated in FIG. 1. As can be seen in FIG. 3, particularly when the simulated stone wall 38 is viewed from an angle, horizontal lines 40 become visible to the human eye. In part, the horizontal lines 40 are visible due to the generally linear top and bottom sides 12 and 14 of the form liners. These top and bottom linear sides 12 and 14 result in semi-continuous horizontal lines 40 along the length of simulated stone wall 38. Similar to the horizontal lines 40, vertical lines may also be visible to the human eye when simulated stone wall 38 is viewed from an angle if prior art form liners having generally linear vertical sides are used. The non-randomness is made even worse when the form liners have fewer sides, which causes more generally linear sides along top, bottom, and/or the sides of the form liners.

Figure 4:
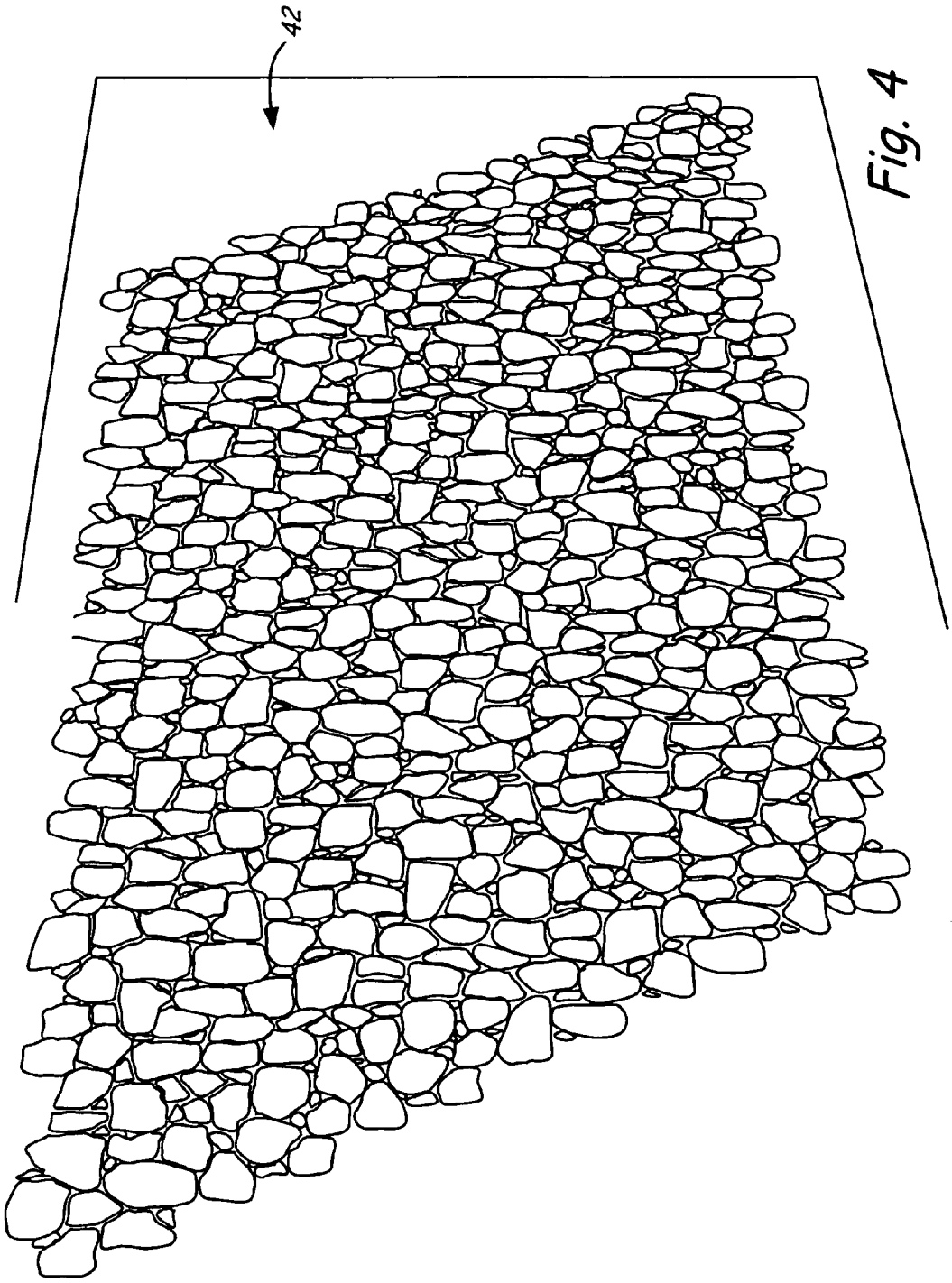
FIG. 4 is a perspective view of a simulated stone wall constructed from form liners of the present invention.
Figure 5A:
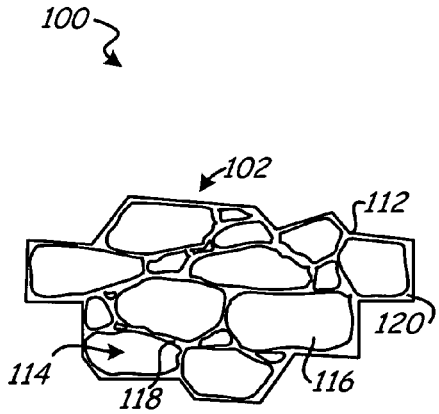
FIG. 5A is a front view of a first embodiment of an individual form liner of the present invention.
Figure 5C:
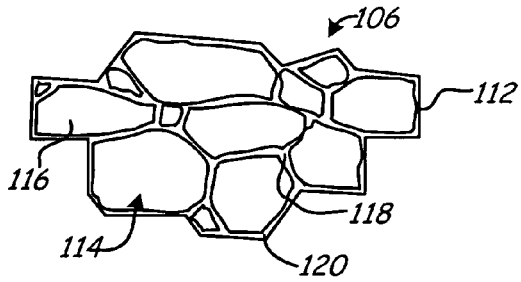
FIG. 5C is a front view of a third embodiment of an individual form liner of the present invention.
Figure 5B:
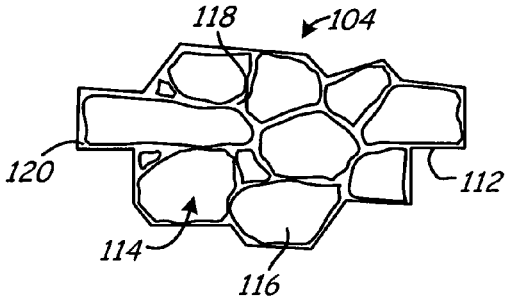
FIG. 5B is a front view of a second embodiment of an individual form liner of the present invention.
Figure 5D:
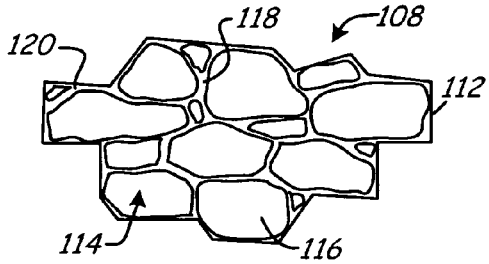
FIG. 5D is a front view of a fourth embodiment of an individual form liner of the present invention.
Figure 5E:
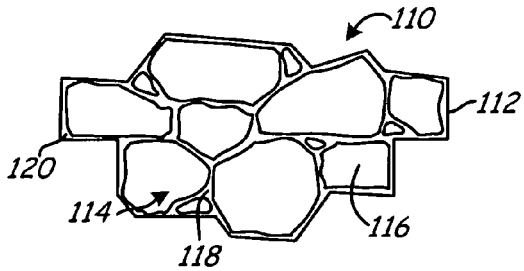
FIG. 5E is a front view of a fifth embodiment of an individual form liner of the present invention.

FIG. 4 depicts a perspective view of a simulated stone wall 42 constructed from a plurality of form liners of the present invention. In contrast to simulated stone wall 38 shown in FIG. 3, simulated stone wall 42 has a more random appearance. Most notably, even when viewed from an angle, horizontal and vertical lines are less visible to the human eye. Horizontal and vertical lines are not readily apparent along simulated stone wall 42 due in part to the improved shape of the form liner of the present invention. Thus, when the form liners are placed adjacent to one another, no semi-continuous lines are created in the finished wall surface. This results in simulated stone wall 42 having a more random surface contour, making individual form liners or repeating patterns more difficult to discern.

FIGS. 5A, 5B, 5C, 5D, and 5E depict form liners of the present invention. Form liners 102, 104, 106, 108, and 110 each comprise an outer edge 112 and a surface 114 that is contoured to resemble a plurality of stones 116 bonded together with an adhesive material, such as mortar 118. In addition to internal mortar regions 118, outer edges 112 of form liners 102, 104, 106, 108, and 110 comprise a half mortar region 120. Half mortar region 120 is necessary so that when form liners 102, 104, 106, 108, and 110 are placed adjacent each other, the two half mortar regions 120 combine to form a single mortar region equal to simulated mortar regions 118. Each form liner 102, 104, 106, 108, and 110 is non-symmetrical and comprises six non-linear connection regions along outer edge 112. Form liners 102, 104, 106, 108, and 110 are used in connection with a hardenable construction material. In one embodiment, the hardenable construction material is concrete. As is known in the art, several form liners 102, 104, 106, 108, and 110 are used in connection with a form to create a simulated stone wall. To increase the realism of the resulting wall, form liners 102, 104, 106, 108, and 110 are designed to interconnect in a manner which ensures that the resulting pattern of stones 116 and mortar regions 118 appears random and reduces the noticeability of horizontal and vertical lines where form liners 102, 104, 106, 108, and 110 interconnect.

For the sake of clarity, the shape of form liners 102, 104, 106, 108, and 110 refers to the outline of form liners 102, 104, 106, 108, and 110 along outer edge 112, while the pattern of form liners 102, 104, 106, 108, and 110 refers to the arrangement of simulated stones 116 and mortar regions 118 of form liners 102, 104, 106, 108, and 110. While each form liner 102, 104, 106, 108, and 110 has the same shape, all form liners 102, 104, 106, 108, and 110 have different patterns of stones 116 and mortar regions 118 and 120.

In designing the pattern of stones 116 and mortar regions 118 and 120 for form liners 102, 104, 106, 108, and 110, it is important to size and scale the stones 116 in a manner which allows stones 116 to fit the shape of form liners 102, 104, 106, 108, and 110. As such, stones 116 are designed so that stones 116 remain whole, even at outer edge 112 of form liners 102, 104, 106, 108, and 110. In other words, none of stones 116 are split at outer edge 112, but rather fit into the outer shape of form liners 102, 104, 106, 108, and 110 so that each stone 116 is surrounded by a mortar region 118 or half mortar region 120.

In determining the pattern of stones 116 for form liners 102, 104, 106, 108, and 110, it is also desired to create patterns of stones on each form liner 102, 104, 106, 108, and 110, which while unique, remain of a similar size and scale. This is because if one stone 116 is much larger than most of the other stones 116, any time the form liner having that stone is used on a wall, the repetition of that distinctive stone 116 becomes more apparent. Such a result is undesirable because it increases the likelihood that an observer will be able to tell that the wall is not a real stone wall, but rather is a simulated stone wall. For patterns having a greater variety of size and shape of stones 116, more form liners may be needed when making the wall surface to ensure the finished wall results in a random appearance. In addition to their size and scale, both the texture of stones 116 and the depth of the stones 116 are preferably kept within a desired range. Keeping the texture and depth of the stones 116 more uniform will also prevent one or more stones from having obvious sizes or patterns, and thus make those stones more easily identified when repeated along the wall surface. The texture and depth of the stones 116 can be designed using any suitable method. One preferred method is to create the form liner by obtaining a mold of natural stones, cut stones, or bricks, such as from an existing real stone wall. From the mold, a form liner can be made using any suitable material, as is known in the art.

In one embodiment, coloring pigments or agents may be added to or dusted onto the form liner before the hardenable material is applied. The pigments serve to color the hardenable material in an effort to increase the level of uniqueness of each stone 116 and to further enhance the natural stone appearance of the resulting surface. Alternately or in addition, coloring pigments may be applied to the surface of the wall after the hardenable material, typically a form of concrete, has dried and the form liners 102, 102, 106, 108, or 110 have been removed.

Although FIGS. 5A, 5B, 5C, 5D, and 5E illustrate form liners 102, 104, 106, 108, and 110 having a pattern commonly referred to as a "field stone" pattern, the invention is not so limited. An infinite variety of stone shapes or sizes 116 and mortar regions 118 may be used in creating the patterns of the form liners 102, 104, 106, 108, and 110. For the sake of simplicity, when the shape of the form liner is important but the pattern is not, form liners 102, 104, 106, 108, and 110 will be referred to as form liner 100.

Figure 6:
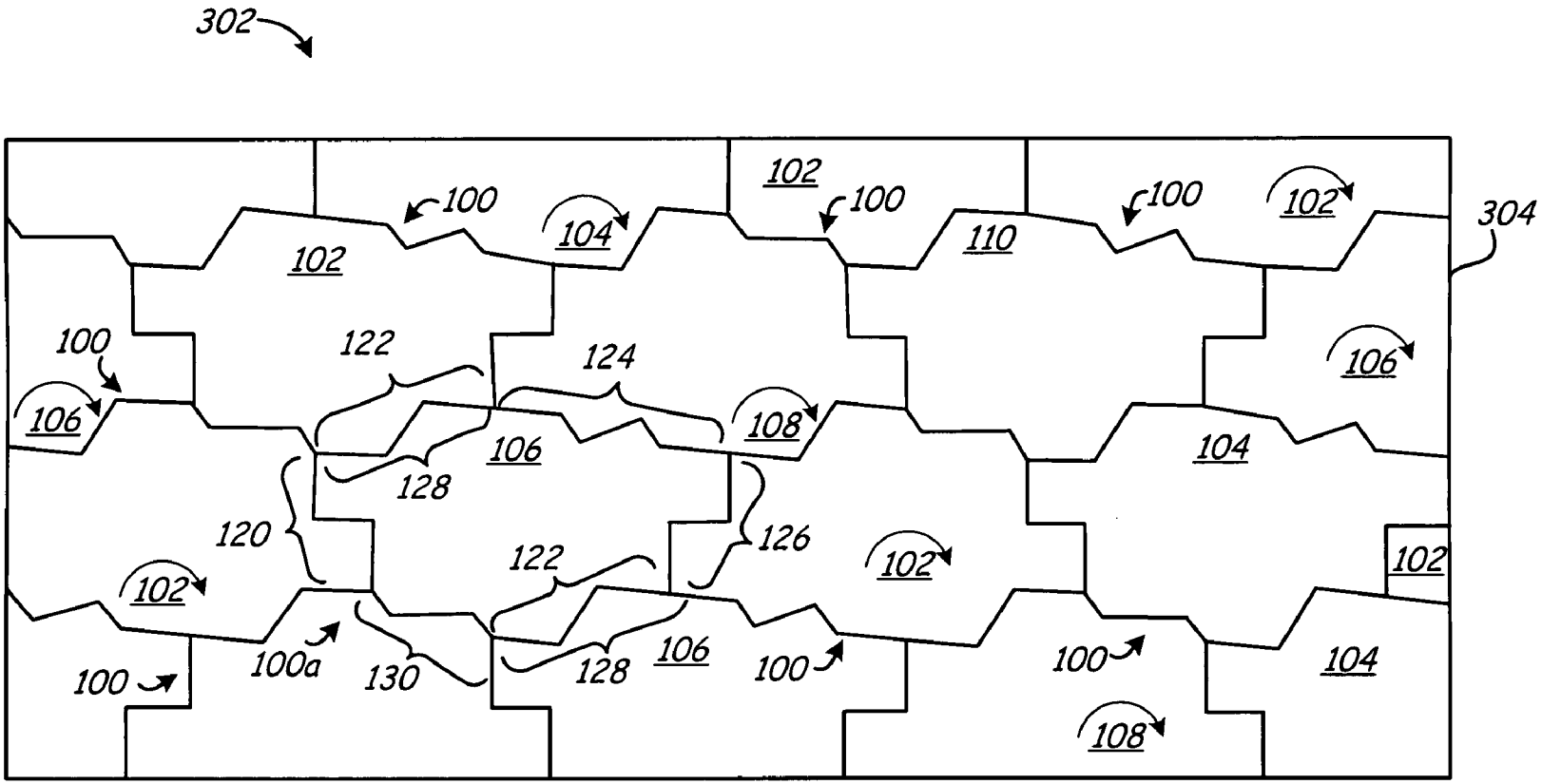
FIG. 6 is a diagrammatic view of a form liner system comprised of a plurality of the form liners of the present invention.

In addition to their patterns, the form liners of the present invention interconnect in a novel manner. FIG. 6 is a diagram of a form liner system 302 illustrating the manner in which a plurality of form liners 100 can be placed adjacent each other on a form 304 when creating a wall. By way of a non-limiting example, the letter in each form liner 100 correlates to the various form liner patterns shown in FIGS. 5A, 5B, 5C, 5D, and 5E. Though each form liner 100 has the same shape, by interconnecting several form liners on a form, the form liner system 302 is easy to install, yet results in a wall having a random pattern and a wall in which the joints created where the form liners meet are more fully masked.

To arrange the form liners 100 on the form 304, a first form liner 100*a* is positioned on the form 304. Once the first form liner 100*a* is placed, all remaining form liners 100 will interconnect in only one manner. This ease of arranging the form liners 100 on a form provides an improvement over previous form liner systems which required detailed diagrams for proper placement of various form liners. More specifically, due to the shape of the form liners 100, each form liner 100 can mate with another form liner 100 along only one connection region. As such, placement of first form liner 100*a* will dictate placement of all additional form liners 100 in the form liner system 302.

Figure 7A:
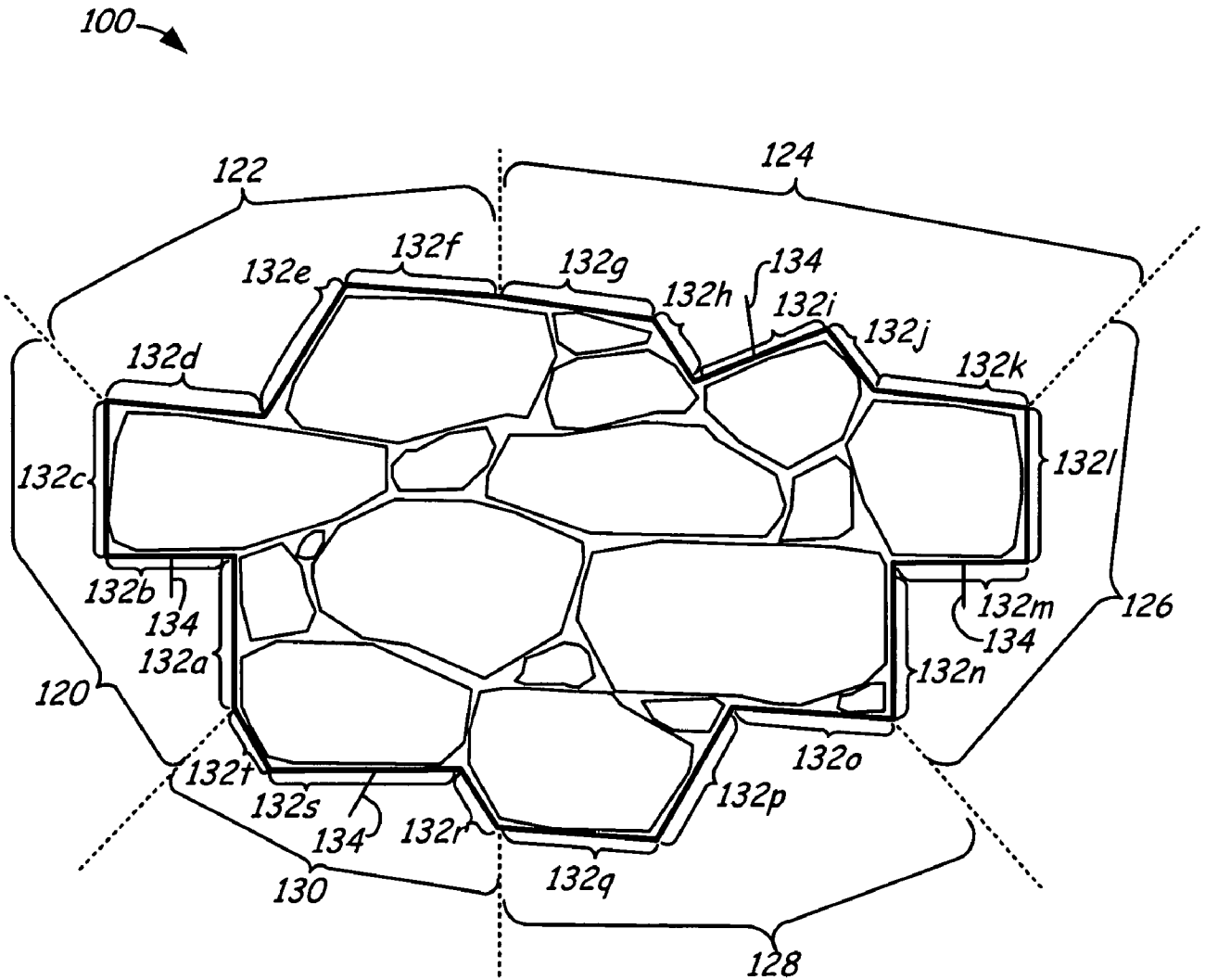
FIG. 7A is a front view of an individual form liner of the present invention showing connection regions.
Figure 7B:
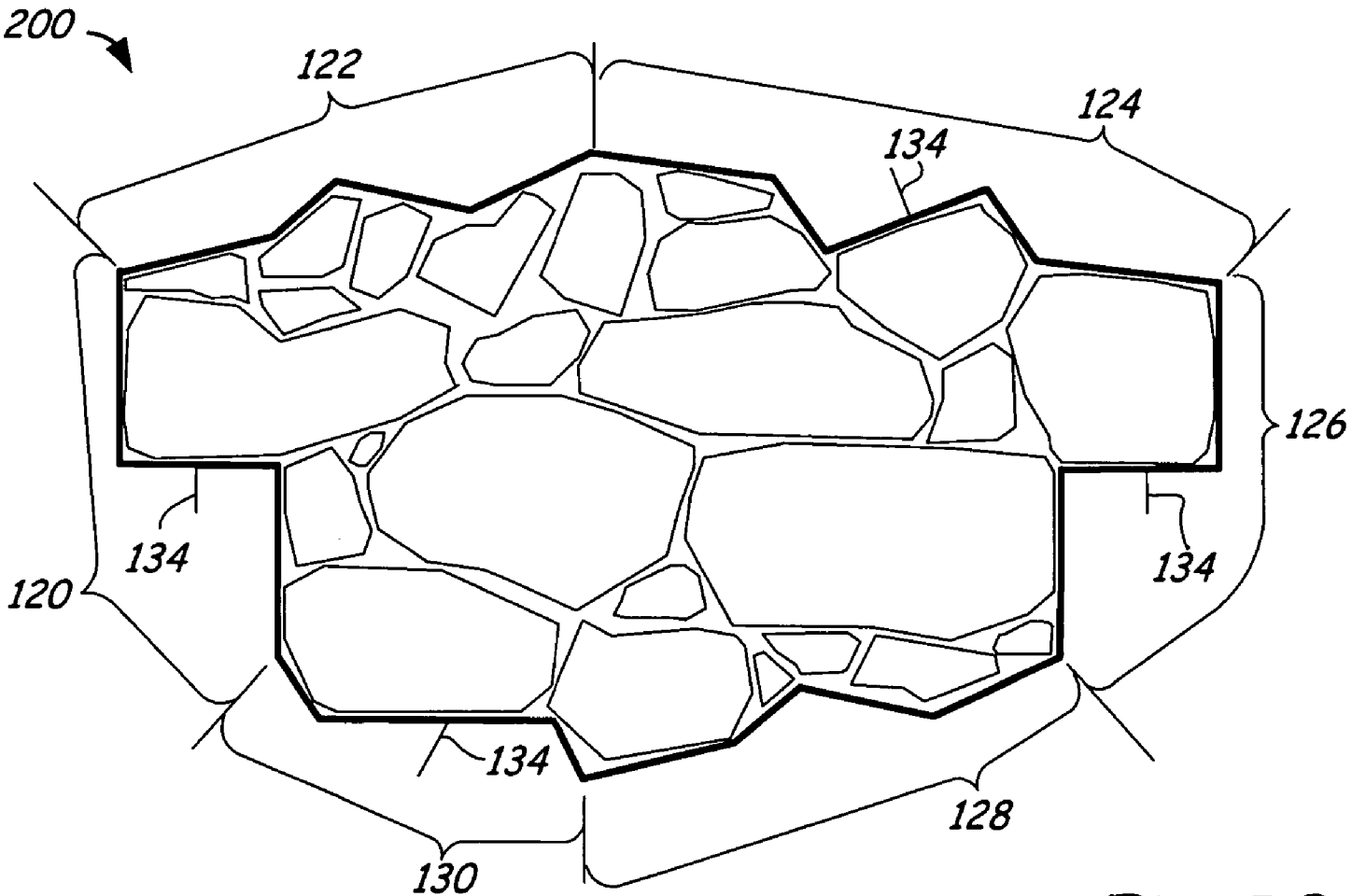
FIG. 7B is a front view of a second embodiment of the individual form liner of the present invention showing connection regions.

FIGS. 7A and 7B illustrate the connection regions of two exemplary form liners of the present invention. Shown in FIG. 7A is a first connection region 120, a second connection region 122, a third connection region 124, a fourth connection region 126, a fifth connection region 128, and a sixth connection region 130. Each connection region 120-130 of form liner 100 is formed of a plurality of linear segments 132, and each connection region 120-130 is designed to mate with a single corresponding connection region 120-130 of an adjacent form liner 100, as illustrated more fully below.

For ease of reference, the shape or linear path of each connection region 120, 122, 124, 126, 128, and 130 is defined as the outline of form liner 100 along outer edge 112 of form liner 100 for the length of the particular connection region 120, 122, 124, 126, 128, and 130.

Linear segments 132*a*-132*t* define the linear paths of each connection region 120-130. In other words, first connection region 120 is formed of three linear segments 132*a*, 132*b*, and 132*c*, and the linear path of first connection region 120 is defined by linear segments 132*a*-132*c*. Similarly, second connection region 122 is formed of linear segments 132*d*-132*f*. Third connection region 124 is formed of linear segments 132*g*-132*k*. Fourth connection region 126 is formed by linear segments 132*l*-132*n*. Fifth connection region 128 is formed by linear segments 132*o*-132*q*. Finally, sixth connection region 130 is formed by linear segments 132*r*-132*t*.

At least two of the six connection regions 120, 122, 124, 126, 128, and 130 of form liner 100 have the same shape or path along outer edge 112. The remaining four connection regions of form liner 100 are of varying lengths. In one embodiment, second connection region 122 and fifth connection region 128 are the same shape along outer edge 112 of form liner 100. As such, the path created by linear segments 132*d*, 132*e*, and 132*f* is the same as the path created by linear segments 132*q*, 132*p*, and 132*o*.

At least four of the six connection regions 120, 122, 124, 126, 128, and 130 of form liner 100 have a 2-fold symmetry, as shown by line 134. Two-fold symmetry exists in a shape when the shape matches itself after being rotated 180 degrees. In one embodiment, first, third, fourth, and sixth connection regions 120, 124, 126, and 130 have 2-fold symmetry 134. This symmetry allows the form liners 100 to interconnect in the desired manner, as described more fully below.

Additionally, none of linear segments 132 defining the shape of fifth connection region 128 follow the same path as any of linear segments 132 defining the shape of sixth connection region 130. Further, the paths of the connection regions 120-130 are all designed to avoid creating a generally linear top or bottom region, and thus minimize the ability of an observer of a wall to detect the location of the rows of form liners used when forming the wall surface.

FIG. 7B shows a second embodiment of form liner 200 of the present invention. Second embodiment form liner 200 illustrates that it is not necessary for all six connection regions 120, 122, 124, 126, 128, and 130 to have 2-fold symmetry in order to form a continuous wall. Notably, second and fifth connection regions 122 and 128 once again have the same path, making the second and fifth connection regions 122, 128 the inverse of each other. As long as this relationship is maintained, the second and fifth connection regions 122 and 128 may take any non-linear or linear path. All other details of second embodiment form liner 200 are identical to form liner 100 described in FIG. 7A.

This design of second and fifth connection regions 122 and 128 allows form liners 100 and 200 to interconnect in a manner that makes it more difficult for the human eye to pick out where the form liners 100 and 200 mate with each other.

Figure 8:
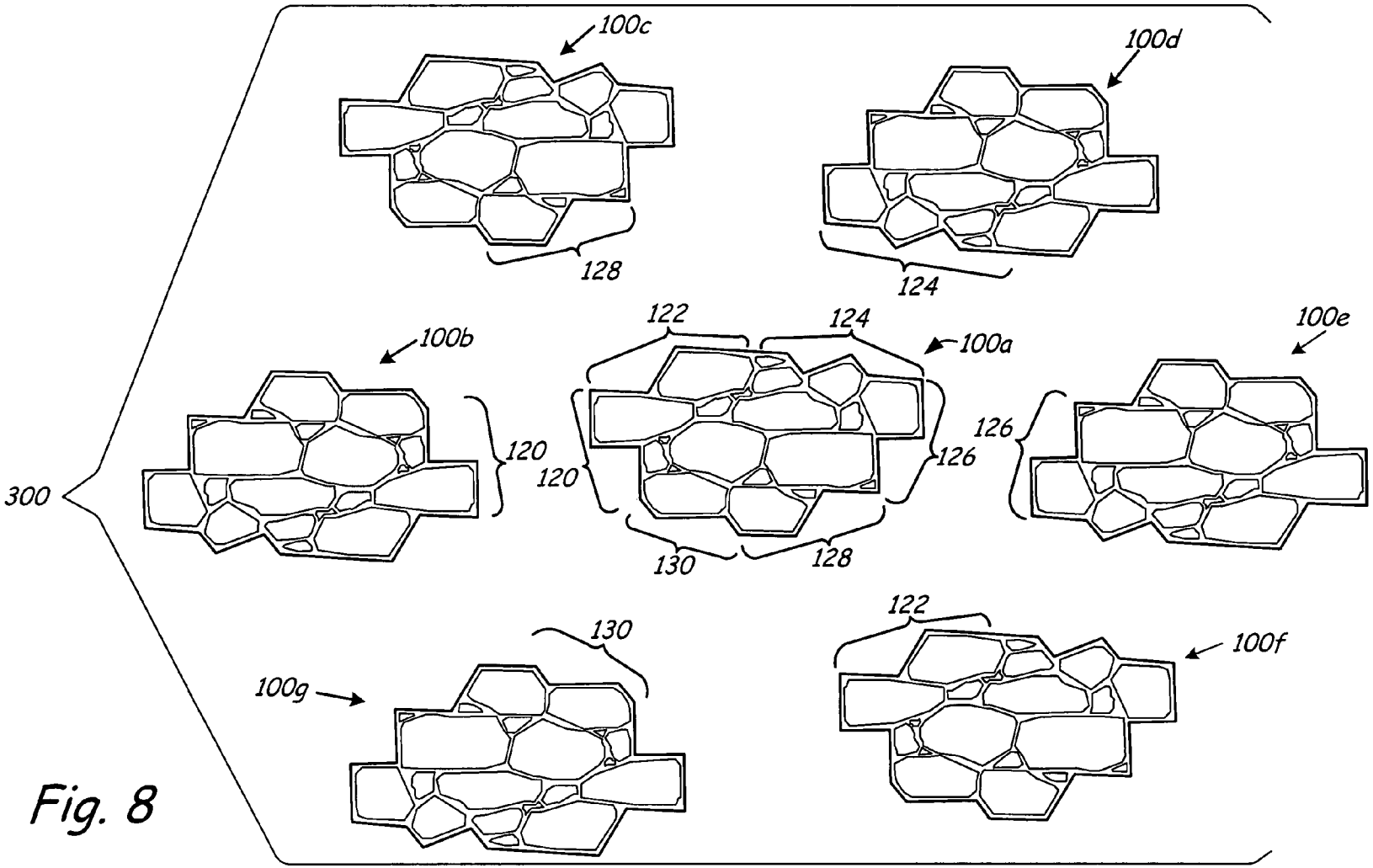
FIG. 8 is an exploded view of a group of form liners illustrating how the form liners interconnect.

To more fully illustrate the interconnection features of the form liners of the present invention, FIG. 8 is an exploded view of a form liner system 300 comprising a plurality of form liners 100. Four connection regions 120, 124, 126, and 130 of the first form liner 100*a* mate with the same corresponding connection region 120, 124, 126, and 130 of another form liner. In this way, the first form liner 100*a* interconnects with six adjacent form liners 100*b*-100*g*.

More specifically, first connection region 120 of first form liner 100*a* mates with first connection region 120 of second form liner 100*b*. Similarly, third connection region 124 of first form liner 100*a* mates with third connection region 124 of fourth form liner 100*d*. Fourth connection region 126 of first form liner 100*a* mates with fourth connection region 126 of fifth form liner 100*e*. Sixth connection region 130 of first form liner 100*a* mates with sixth connection region 130 of seventh form liner 100*g*. When the four form liners 100*b*, 100*d*, 100*e*, and 100*g* interconnect with the first form liner 100*a*, each form liner 100*b*, 100*d*, 100*e*, and 100*g* is rotated 180 degrees relative to first form liner 100*a*.

The remaining two form liners 100*b* and 100*f* interconnect with the first form liner 100*a* in a different manner. More specifically, second connection region 122 of first form liner 100*a* mates with fifth connection region 128 of third form liner 100*c*. Similarly, fifth connection region 128 of first form liner 100*a* mates with second connection region 122 of sixth form liner 100*f*. When the second 100*b* and fifth 100*f* form liners interconnect with the first form liner 100*a*, the form liners 100*b* and 100*f* are not rotated 180 degrees.

Rather, as described above, because the paths of the second and fifth connection regions are the same, the form liners do not interconnect at the same connection region, but rather at the inverse, corresponding interconnection region. In other words, the second connection region of the first form liner 100*a* interconnects with a fifth connection region of another form liner, and the fifth connection region of the first form liner 100*a* interconnects with a second connection region.

Figure 9:
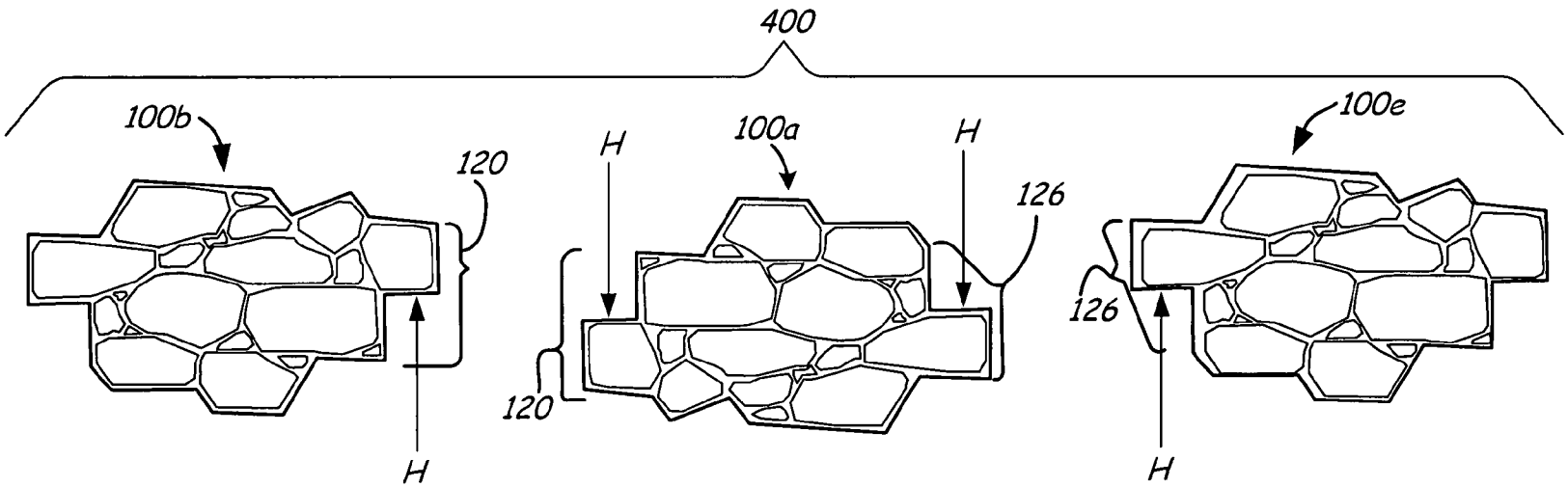
FIG. 9 is a view of three form liners of form liner system of FIG. 8 illustrating how the form liners interconnect along a horizontal.

FIG. 9 shows the connections of form liners 100*b*, 100*a*, 100*e* of form liner system 300 shown in FIG. 8. First connection region 120 of second form liner 100*b* and fourth connection region 126 of fifth form liner 100*e* are designed to mate respectively with first and fourth connection regions 120 and 126 of first form liner 100*a* along a generally horizontal segment H relative to first form liner 100*a*. Each form liner 100*b*, 100*e* connected to first form liner 100*a* along generally horizontal segment H is inverted with respect to first form liner 100*a* so that first connection region 120 of second form liner 100*b* and fourth connection region 126 of fifth form liner 100*e* are aligned to mate with first and fourth connection regions 120, 126 of first form liner 100*a*.

When interconnected along a generally horizontal row as illustrated in FIG. 9, the resulting row 400 of form liners 100*b*, 100*a*, and 100*e* has a very non-linear top and bottom. This helps to mask the formation of the row of form liners 100*b*, 100*a*, and 100*e*, so that when viewing the finished wall surface, the location of the rows of form lines is not immediately obvious.

Figure 10:
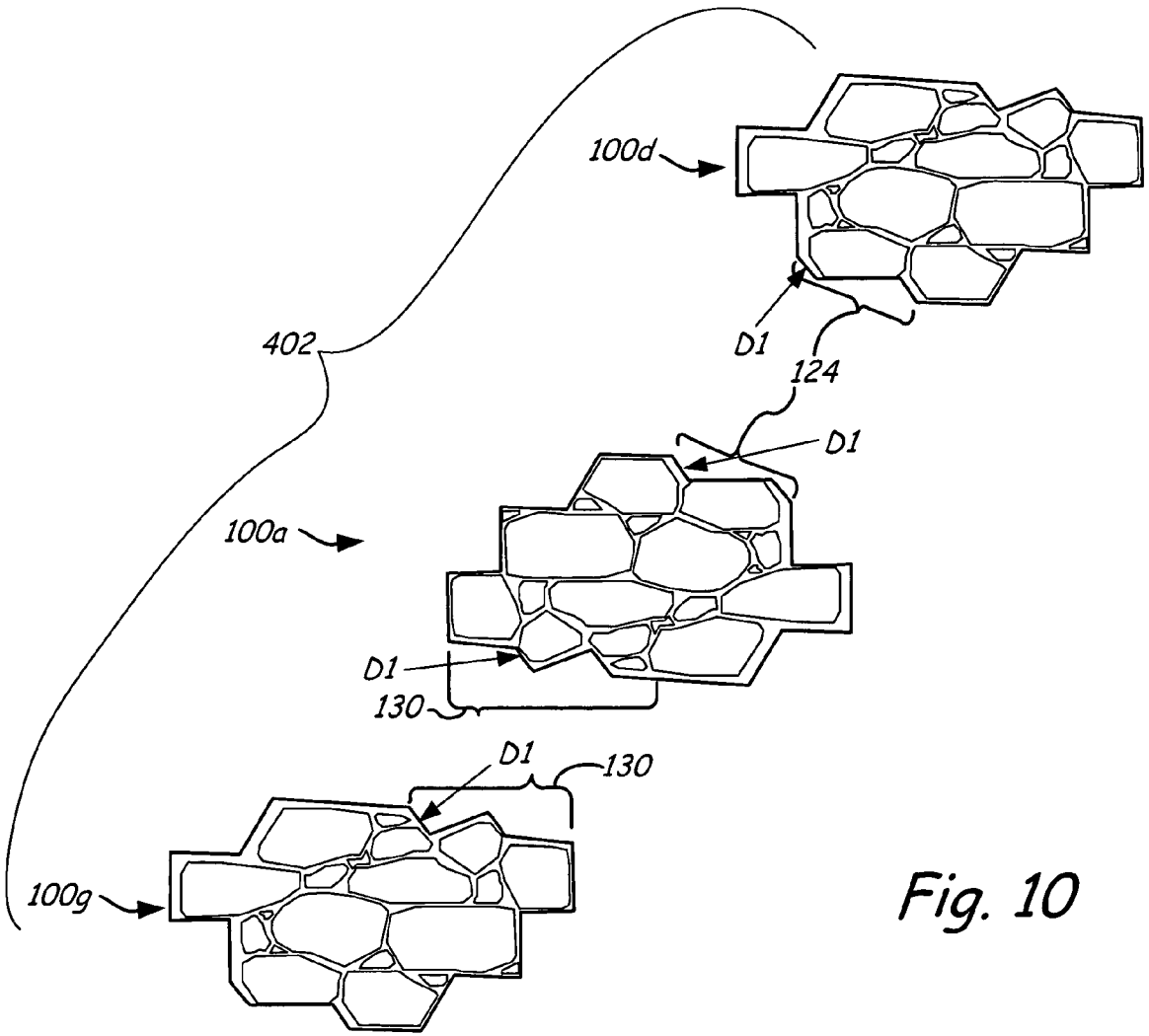
FIG. 10 is a view of three form liners of form liner system of FIG. 8 illustrating how the form liners interconnect along a first diagonal.

FIG. 10 shows the connections of form liners 100*g*, 100*a*, 100*d* of form liner system 300 shown in FIG. 8. Sixth connection region 130 of seventh form liner 100*g* and third connection region 124 of fourth form liner 100*d* are designed to mate respectively with sixth and third connection regions 130 and 124 of first form liner 100*a* along a first diagonal segment D1 relative to first form liner 100*a*. Each form liner 100*g*, 100*d* connected to first form liner 100*a* along first diagonal segment D1 is inverted with respect to first form liner 100*a* so that sixth connection region 130 of seventh form liner 100*g* and third connection region 124 of fourth form liner 100*d* are aligned to mate with seventh and third connection regions 130, 124 of first form liner 100*a* to form a row 402.

Figure 11:
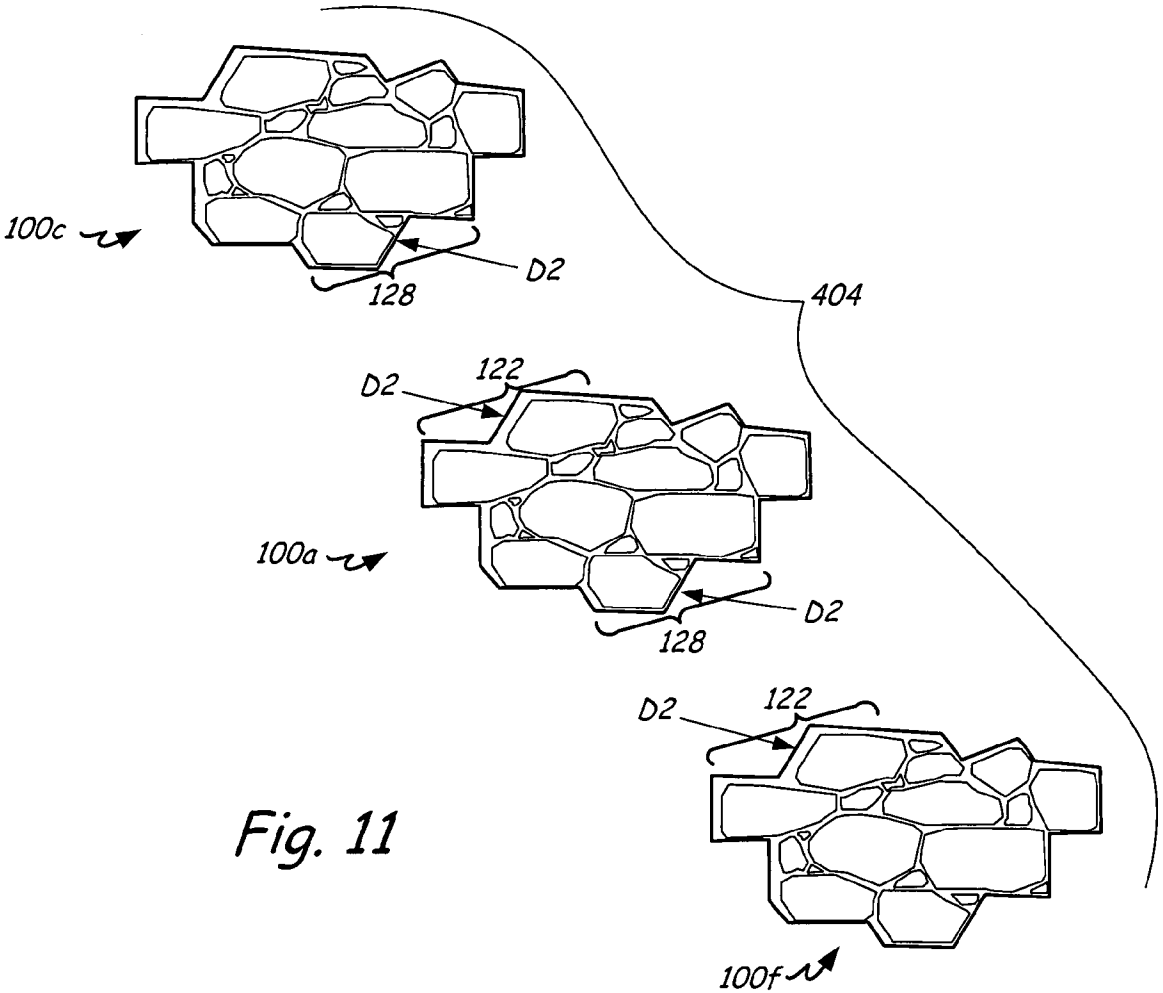
FIG. 11 is a view of three form liners of form liner system of FIG. 8 illustrating how the form liners interconnect along a second diagonal.

FIG. 11 shows the connection of form liners 100*c*, 100*a*, and 100*f* of form liner system 300 shown in FIG. 8. Second connection region 122 of sixth form liner 100*f* and fifth connection region 128 of third form liner 100*c* are designed to mate respectively with fifth and second connection regions 128 and 122 of first form liner 100*a* along a second diagonal segment D2 relative to first form liner 100*a*. Each form liner 100*c* and 100*f* connected to first form liner 100*a* along second diagonal segment D2 is oriented in the same orientation as first form liner 100*a* to form a row 404.

Figure 12:
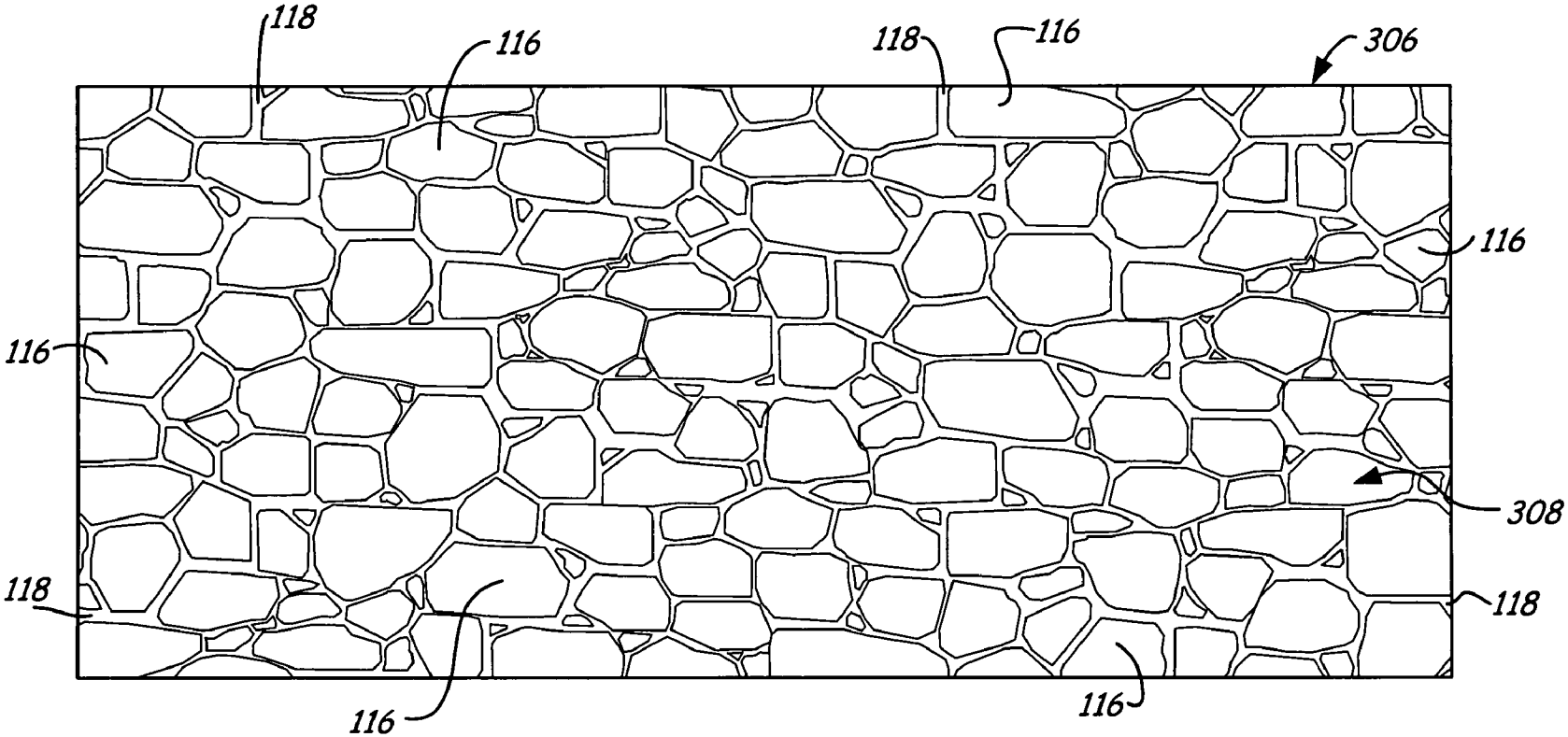
FIG. 12 is a front view of a simulated stone wall constructed from form liners of the present invention.

FIG. 12 depicts a simulated stone wall 306 constructed from a form liner system of the present invention. Simulated stonewall 306 is a result of arranging and connecting form liners 100 as shown in FIG. 6, and as described with reference to FIGS. 8-11. Surface 308 of resulting simulated stone wall 306 has the appearance of being built from various natural stones 116 stacked on top of one another and bonded together by a mortar-like adhesive 118. By using a variety of embodiments of form liner 100 (as shown in FIGS. 5A, 5B, 5C, 5D, and 5E), surface 308 of simulated stone wall 306 appears to have a random stone pattern with no easily discernible vertical or horizontal lines. Further, the joints between the individual form liners 100 used in creating the wall surface 308 are masked.

The form liner system of the present invention achieves the look of a simulated stone wall having a random pattern due to the complex shape of the form liners used. Despite the complexity of the form liner shapes, it remains simple to interconnect the form liners due to the design of the interconnection regions of the form liner. In particular, once the first form liner is placed on a form, all adjacent form liners interconnect with the first form liner in only one configuration. As a result, the form liner system can make use of only one shape of form liner made in a variety of different patterns. As the form liners are arranged, a random pattern of stones, having no easily discernible vertical or horizontal lines, will result with ease.

Although the present invention has been described with reference to preferred embodiments, workers skilled in the art will recognize that changes may be made in form and detail without departing from the spirit and scope of the invention.

The invention claimed is:

1. A form liner for use in creating a simulated stone wall having a random pattern, the form liner comprising:

a surface contoured to resemble a plurality of stones; and an outer edge consisting of six non-overlapping connection regions, wherein the six regions are oriented such that a first region connects with a second region, the second region connects with a third region, the third region connects with a fourth region, the fourth region connects with a fifth region, the fifth region connects with a sixth region, and the sixth region connects with the first region, the six regions creating a closed outer edge, each connection region being non-linear and having a plurality of linear edge segments which form a mating profile, wherein the mating profile of each of the first, third, fourth and sixth connection regions exactly mates only with the mating profile of the first, third, fourth, and sixth connection regions, respectively, of another form liner, the mating profile of the second connection region exactly mates only with the mating profile of the fifth connection region of another form liner, and the mating profile of the fifth connection region exactly mates only with the mating profile of the second connection region of another form liner, wherein each of the first, third, fourth, and sixth connection regions has an odd number of linear segments with one of the linear segments being a center segment, and wherein each of the first, third, fourth and sixth connection regions has 2-fold symmetry about an axis which extends through a midpoint of the center segment.

2. The form liner of claim 1, wherein no linear segment of the fifth connection region follows the same linear path as any linear segment of the sixth connection region.

3. The form liner of claim 1, wherein the outer edge defines an asymmetric form liner shape.

4. A form liner system for use in creating a simulated stone wall having a random pattern, the system comprising:

a first and a second form liner, each form liner comprising:

a surface contoured to resemble a plurality of stones; and an outer edge consisting of six non-overlapping connection regions, wherein the six regions are oriented such that a first region connects with a second region, the second region connects with a third region, the third region connects with a fourth region, the fourth region connects with a fifth region, the fifth region connects with a sixth region, and the sixth region connects with the first region, the six regions creating a closed outer edge, each connection region being non-linear and having a plurality of linear edge segments which form a mating profile, wherein the mating profile of each of the first, third, fourth and sixth connection regions exactly mates only with the mating profile of the first, third, fourth, and sixth connection regions, respectively, of another form liner, the mating profile of the second connection region exactly mates only with the mating profile of the fifth connection region of another form liner, and the mating profile of the fifth connection region exactly mates only with the mating profile of the second connection region of another form liner, wherein each of the first, third, fourth, and sixth connection regions of the first and second form liners has an odd number of linear segments with one of the linear segments being a center segment, and wherein each of the first, third, fourth and sixth connection regions has 2-fold symmetry about an axis which extends through a midpoint of the center segment.

5. The form liner system of claim 4, wherein no linear segment of the fifth connection region follows the same linear path as any linear segment of the sixth connection region.

6. The form liner system of claim 4, the first and second form liners having no symmetry.

7. The form liner system of claim 6, wherein one of the first, third, fourth, and sixth connection regions of the second form liner is configured to exactly mate with one of the first, third, fourth, and sixth connection regions of the first form liner by orienting the second form liner so that it is rotated through an angle of 180 degrees with respect to the orientation of the first form liner.

8. The form liner system of claim 7, wherein the first connection region of the first form liner exactly mates only with the first connection region of the second form liner.

9. The form liner system of claim 7, wherein the third connection region of the first form liner exactly mates only with the third connection region of the second form liner.

10. The form liner system of claim 7, wherein the fourth connection region of the first form liner exactly mates only with the fourth connection region of the second form liner.

11. The form liner system of claim 7, wherein the sixth connection region of the first form liner exactly mates only with the sixth connection region of the second form liner.

12. The form liner system of claim 6, wherein when the second form liner is in an orientation in which it is rotated through an angle of 180 degrees with respect to the orientation of the first form liner, then one of the six connection regions of the second form liner selected from the group consisting of the first, third, fourth, and sixth connection regions exactly mates with one connection region of the first form liner selected from the group consisting of the first, third, fourth, and sixth connection regions.

13. The form liner system of claim 6, wherein the second connection region of the first form liner exactly mates only with the fifth connection region of the second form liner.

14. The form liner system of claim 6, wherein the fifth connection region of the first form liner exactly mates only with the second connection region of the second form liner.

15. A form liner system for use in creating a simulated stone wall having a random pattern, the system comprising:

a first, second, and third form liner, wherein the second and third form liners are arranged in a generally horizontal row, wherein the first and second form liners are aligned along a first diagonal, wherein the first and third form liners are aligned along a second diagonal, each form liner comprising:

a surface contoured to resemble a plurality of stones; and an outer edge consisting of a first, second, third, fourth, fifth, and sixth non-overlapping connection regions, the first region connecting to the second and sixth regions, the third region connecting to the second and fourth regions, and the fifth region connecting to the fourth and sixth regions, the six regions creating a closed outer edge, each connection region being non-linear and having a plurality of linear segments which form a mating profile, wherein the mating profile of each of the first, third, fourth and sixth connection regions exactly mates only with the mating profile of the first, third, fourth, and sixth connection regions, respectively, of another form liner, the mating profile of the second connection region exactly mates only with the mating profile of the fifth connection region of another form liner, and the mating profile of the fifth connection region exactly mates only with the mating profile of the second connection region of another form liner, wherein each of the first, third, fourth, and sixth connection regions of each of the first, second, and third form liners has an odd number of linear segments with one of the linear segments being a center segment, and wherein each of the first, third, fourth and sixth connection regions has 2-fold symmetry about an axis which extends through a midpoint of the center segment.

16. The form liner system of claim 15, wherein no linear segment of the fifth connection region follows the same linear path as any linear segment of the sixth connection region.

17. The form liner system of claim 16, wherein the first, second, and third form liners have an asymmetric shape.

18. The form liner system of claim 17, wherein along the first diagonal, the second form liner has an orientation in which it is rotated through an angle of 180 degrees with respect to an orientation of the first form liner so as to allow one of the six connection regions of the second form liner to exactly mate with one of the six connection regions of the first form liner.

19. The form liner system of claim 17, wherein along the second diagonal, the third form liner has a same orientation with respect to the first form liner and the third form liner is adapted to allow either the second connection region or the fifth connection region thereof to exactly mate with either the fifth connection region or the second connection region, respectively, of the first form liner.

20. The form liner system of claim 17, wherein along the first diagonal, the first form liner is placed so that the third connection region of the first form liner exactly mates only with the third connection region of the second form liner.

21. The form liner system of claim 20, wherein along the first diagonal, the first form liner is placed so that the sixth connection region of the first form liner exactly mates only with the sixth connection region of a fourth form liner.

22. The form liner system of claim 19, wherein along the second diagonal, the first form liner is placed so that the second connection region of the first form liner exactly mates only with the fifth connection region of the third form liner.

23. The form liner system of claim 19, wherein along the second diagonal, the first form liner is placed so that fifth connection region of the first form liner exactly mates only with the second connection region of a fifth form liner.

24. The form liner system of claim 17, wherein along the horizontal row, the third form liner has an orientation in which it is rotated through an angle of 180 degrees with respect to an orientation of the second form liner and the third form liner is adapted to allow only one of the six connection regions thereof to exactly mate with only one of the six connection regions of the second form liner.

25. The form liner system of claim 24, wherein the first connection region of the first form liner exactly mates only with the first connection region of a sixth form liner.

26. The form liner system of claim 24, wherein the fourth connection region of the first form liner exactly mates only with the fourth connection region of a seventh form liner.

* * * * *